US005853311A

United States Patent [19]

Bartholomew

[11] Patent Number: 5,853,311

[45] Date of Patent: Dec. 29, 1998

[54] MULTI-LAYERED FLYING DISK

[76] Inventor: Mark Bartholomew, 2820 Bardswood, Tallahassee, Fla. 32304

[21] Appl. No.: 620,402

[22] Filed: Mar. 22, 1996

[51] Int. Cl.[6] ..... A63B 65/10

[52] U.S. Cl. ..... 446/48; 473/588

[58] Field of Search ..... 446/46, 47, 48; 473/588, 589

[56] References Cited

U.S. PATENT DOCUMENTS

| | | | |
|---|---|---|---|
| 1,404,132 | 1/1922 | Manes | 446/46 |
| 2,886,320 | 5/1959 | Van Hennik | 473/588 |
| 3,852,910 | 12/1974 | Everett | 446/46 |
| 3,939,602 | 2/1976 | Burke et al. . | |
| 4,112,612 | 9/1978 | Woods | 446/48 |
| 4,176,843 | 12/1979 | DeWitt, Jr. | 446/46 |
| 4,182,073 | 1/1980 | Tabet | 446/46 |
| 4,255,893 | 3/1981 | Anderson et al. . | |
| 4,503,635 | 3/1985 | Harrington | 446/46 |
| 4,820,230 | 4/1989 | Richards | 446/48 |
| 5,020,808 | 6/1991 | Richards | 446/48 |
| 5,080,624 | 1/1992 | Brinker | 446/48 |
| 5,358,440 | 10/1994 | Zheng | 446/48 |

FOREIGN PATENT DOCUMENTS 2250212 1/1987 United Kingdom .

*Primary Examiner*—Robert A. Hafer
*Assistant Examiner*—Jeffrey D. Carlson
*Attorney, Agent, or Firm*—Peter Loffler

[57] ABSTRACT

The flyer of the present invention comprises an upper main disk and a lower ring made from lightweight sheet material. The upper main disk and lower ring connect via an attachment element. Design, construction and assembly of the flyer of the present invention produce a stable flyer; when thrown flat, the flyer flies flat. Design, construction and assembly reduce or eliminate veering, an inherent characteristic of other common flyers. Distinguishing flight features of the flyer of the present invention arise where the design and construction of the flyer include a main disk and a lower ring separated by the attachment element, usually cut from the upper main disk and lower ring. Action between air and the upper main disk, lower ring and attachment means produce desirable flight features.

13 Claims, 3 Drawing Sheets

MULTI-LAYERED FLYING DISK

BACKGROUND OF THE INVENTION

1. Field of the Invention

The present invention relates generally to flying disks and more particularly relates to hand tossed flying disks which when thrown, will fly in a straight line. The disk of the present invention is also suited for indoor use and includes more than one interconnected layer.

2. Description of the Related Art

Many hand tossed disks exist today which are fabricated from material, such as cardboard, foam, or the like, in order to provide indoor as well as outdoor use. One such disk is disclosed in U.S. Pat. No. 5,358,440 issued to Yu Zheng. Yu Zheng discloses a collapsible flying disk comprising a first rim member and a panel substantially covering the rim member. The first and second rim members are disposed in different elevational planes, but parallel to each other so that the collar is disposed at an angle, thereby forming a dome. Such a design and configuration will enable flight, however if not thrown correctly, can curve and veer substantially and cause an unsuccessful flight. Additionally, the use of mesh material for panel, as disclosed in Zheng will not render adequate air flow causing the disk to veer and not fly in a horizontal straight line.

Yet another device is disclosed in United Kingdom Patent GB 2 250 212 A issued to Leachman. Leachman discloses a multi-layered flying disk which includes a first lower ring having a central aperture and a second lower ring having a second aperture. This flying disk may be somewhat successful for flight, but the design and use of two central apertures causes a disk which cannot achieve flight in a straight path. The use of the aligned apertures and cone fail to have the air form a vortex and prevent air flow upwards, inherently failing to enable hovering to occur. Hence, it is seen that Leachman like Zheng will provide a flying disk which will produce undesirable air patterns, intrinsically causing the disk to veer left.

As evidenced by the above patents, none of these previous efforts provide the benefits intended with the present invention, such as providing a flying disk which is easy to use and assemble and will fly horizontally and in a straight line. Additionally, prior techniques do not suggest the present inventive combination of component elements as disclosed and claimed herein. The present invention achieves its intended purposes, objectives and advantages over the prior art by providing a device that will enable horizontal flight for indoor or outdoor use through a new, useful and unobvious combination of component elements. The device of the present invention is simple to use and is inexpensive to manufacture, and assemble. Additionally, the present invention employs only readily available material.

BRIEF SUMMARY OF THE INVENTION

The flying disk of the present invention comprises an upper main disk and a lower ring made from lightweight sheet material. The upper main disk and lower ring connect by an attachment means for providing the upper ring to be secured above the lower ring and rendering a gap to be located therebetween. Design, construction and assembly of the flyer of the present invention produces a stable flyer. When thrown flat, the flyer flies flat. Design, construction and assembly reduce or eliminate veering, an inherent characteristic of other common flyers.

The upper main disk includes at least five apertures, evenly spaced and disposed around the edge of the main disk. The lower ring is generally circular and includes a central aperture.

Distinguishing flight features of the flyer of the present invention arise where the design and construction of the flyer include disks separated by attachment means, usually cut from the upper main disk and lower ring. When the flyer is thrown, usually manually, the flyer spins. When flying, the flyer divides air into: (i) air under the lower ring, (ii) air between the lower ring and upper main disk and (ii) air over the upper main disk.

The attachment means acts on the air between the lower ring and upper main disk, urging that air into swirling or vortex patterns. Some air between the lower ring and upper main disk exits above the flyer through the cutouts or apertures in the upper main disk. Air also exits between the gap, the area located between the lower ring and upper main disk. Some air will also exits below the flyer through the central aperture in the lower ring. The swirling or vortex pattern of air exiting above or below the flyer produces stable flight, especially when joined with swirling or vortexing air under the lower ring and above the upper main disk. Air coming into direct contact with a spinning flyer under the lower ring and above the upper main disk swirls due to friction. Stationary air contacting moving air becomes entrained and moves due to friction. This combination of air flow causes the disk to fly in a straight line and not veer.

The present invention also provides a unique method for fabricating the flying disk. This method includes the steps of die cutting the main upper disk, lower ring and attaching means from a single sheet of material. Once die cut, the disk can optionally be assembled by the manufacturer and packaged or immediately packaged by the manufacturer for enabling assembly by the consumer.

Accordingly, it is the object of the present invention to provide a flying disk which is easy to assemble and manufacture as well as provide a disk which can be used and assembled by any user, despite experience, age, knowledge or manual dexterity for providing a flying disk which when thrown will have a straight, level and planar flight pattern.

It is yet another object of the present invention to provide for a flying disk which is fabricated from a soft and lightweight material, and provide a disk which is suited for both indoor and outdoor use.

Still a further object of the present invention is to provide a flying disk which will overcome the deficiencies, shortcomings, and drawbacks of prior flying disks and method thereof.

It is still a further object of the present invention, to be specifically enumerated herein, to provide a flying disk device in accordance with the preceding objects and which will conform to conventional forms of manufacture, be of simple construction and easy to use so as to provide a device that would be economically feasible, long lasting and relatively trouble free in operation.

Although there have been many inventions related to flying disks, none of the inventions have become sufficiently compact, low cost, and reliable enough to become commonly used. The present invention meets the requirements of the simplified design, compact size, low initial cost, low operating cost, ease of assembly and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF DRAWINGS

Similar reference numerals refer to similar parts throughout the views of the drawings.

DESCRIPTION OF PREFERRED EMBODIMENT

Figure 1A:
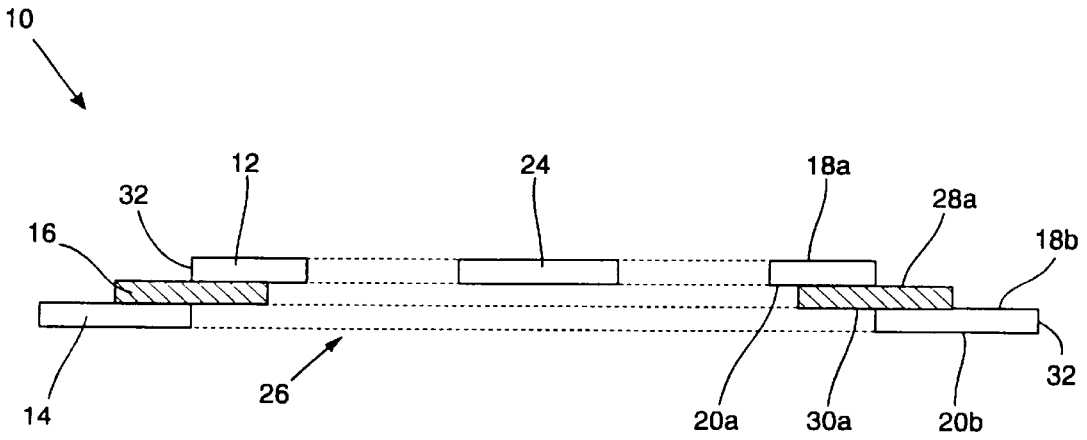
FIG. 1*a* is a cross-sectional view of the first embodiment of the flying disk of the present invention taken along lines 1*a*–1*a* of FIG. 1*b*.
Figure 1B:
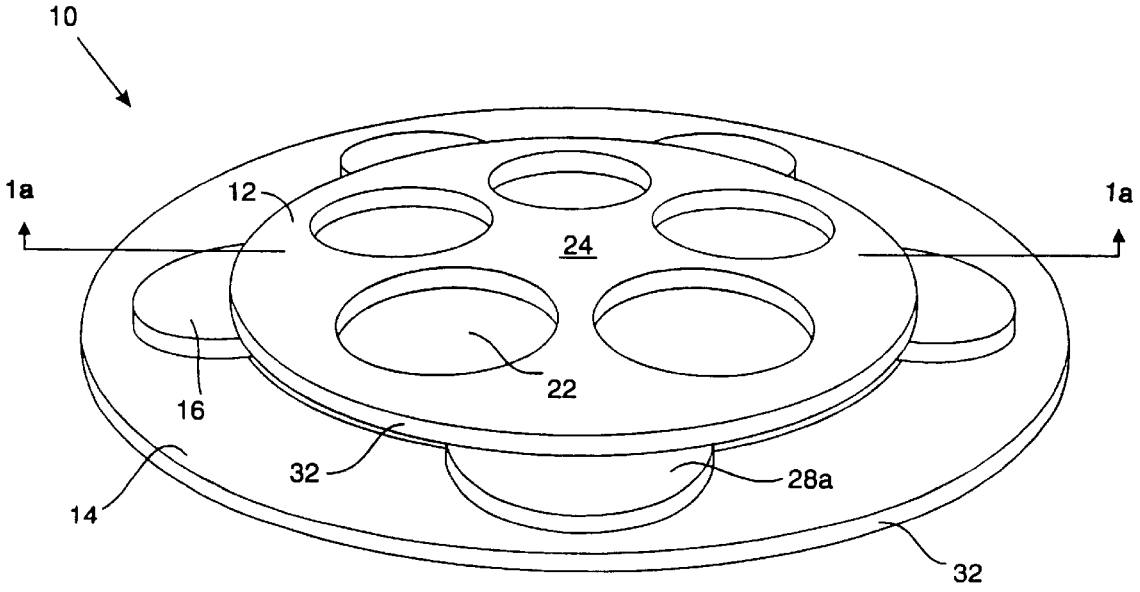
FIG. 1*b* is a perspective view of the first embodiment of the flying disk of the present invention.

FIGS. 1*a* and 1*b* illustrate the first embodiment of the hand tossed flying disk of the present invention. As best seen in FIGS. 1*a* and 1*b*, the hand tossed flying disk 10 comprises an upper main disk 12 connected above a lower ring 14 by attachment means 16 and 16*a*, respectively.

The upper main disk 12 is generally circular and planar and includes an upper surface 18*a* and a lower surface 20*a*. The attachment means (16 in FIG. 1*a* and 16*a* in FIG. 1*b*) is secured to the lower surface 20*a* of the upper main disk 12. This lower surface 20*a* is also designed and configured to face downward and in the direction of the lower ring when the flying disk 10 is in an assembled position. Extending through the upper main disk 12 are five apertures 22. These apertures 22 are evenly spaced and are located in proximity to the outer edge of the upper main disk. This design and configuration will provide for a spacer 24 to be centrally located on the upper main disk. This spacer 24 is will limit air flow centrally upward and is configured such that the manufacture, user, or the like are able to place a design, advertisement, school logo or the like, on the upper surface 18*a* of the upper main disk 12.

The configuration of the apertures is such that the surface area covered by the apertures is at least approximately equivalent to the surface area of the solid material surrounding the apertures (plus or minus 10 percent). Applicant has discovered that the use of five apertures located in proximity to the outer edge of the main disk will optimize a formation of a vortex, once the flying disk is tossed.

The lower ring 14 has an annular shape and as such includes a central hole or aperture 26. This central aperture 26 has a diameter which is substantially equal to the diameter of the outer edges of the upper main disk. The lower ring 14 has an upper surface 18*b* and a lower surface 20*b*. Once assembled, the upper surface 18*b* of the lower ring 14 faces the lower surface 20*a* of the upper main disk 12. The attaching means (16 in FIG. 1*a* and 16*a* in FIG. 1*b*) secures the upper main disk 12 to the lower ring 14 and inherently causes a gap to be located between the upper main disk and lower ring.

The attaching means 16*a* are a plurality of tabs. For conserving material, these tabs can be formed from the material left from the apertures 22 of the upper main disk 12. In the first embodiment of the present invention, the tabs include an upper surface 28*a* and a lower surface 30*a*. The upper surface 28*a* of the attachment means is secured to lower surface 20*a* of the upper main disk 12 via a securing means. The lower surface 30*a* of the attachment means is secured to the upper surface 18*b* of the lower ring 14. The securing means can be any conventional securing means, such as epoxy, glue, paste, rubber cement, adhesives, mechanical fasteners, such as pins, staples or the like.

The edges 32 of both the upper main disk 12 and lower ring 14 should be straight and planar. This will provide for air to contact the surface area of the edge of the upper main disk and lower ring and force the upper main disk and lower ring to turn and rotate.

To utilize the disk 10 of the present invention, the user merely tosses the disk as with a conventional disk. Accordingly, the user grasps the upper main disk 12 with the lower surface of their thumb. The thumb should be located above an attachment means (16 in FIG. 1*a* and 16*a* in FIG. 1*b*). The pointer or index finger should be placed comfortably on the edge 32 of the lower ring 14. The middle finger, ring finger and pinkie should be curved towards the user. Using a flying motion of the wrist, the flying disk 10 is tossed.

When tossed, air flows under the lower ring and through the apertures 22 of the upper main ring. Air is also able to escape via the gap located between the upper main disk and lower ring. The attachment means acts on the air between the lower ring and upper main disk, urging that air into swirling or vortex patterns, escaping the apertures 22 in a vortex pattern. The air contacting the edges also aids in the rotation of the flying disk. The swirling or vortex pattern of air exiting above or below the flyer produces stable flight especially when jointed with swirling or vortexing air under the lower ring and above the upper main disk. Air coming into direct contact with a spinning flyer under the lower ring and above the upper main disk swirls due to friction. Stationary air contacting moving air becomes enstrained and moves due to friction.

The use of the five apertures provides a flying structure which, when in flight, causes the air flow to form a perfect vortex, inherently causing a perfect flight. The positioning and size of the apertures is such that the area covered by the apertures is at least approximately equivalent to the surface area of the solid material in the main disk. Additionally, it is noted that the size of the spacer 24 (center of the main disk 12) is approximately equivalent to (plus or minus 10 percent) of a single aperture. It has been discovered that this particular placement of the apertures and the size of the apertures located in the main disk will form a perfect vortex when the device is thrown.

Figure 2:
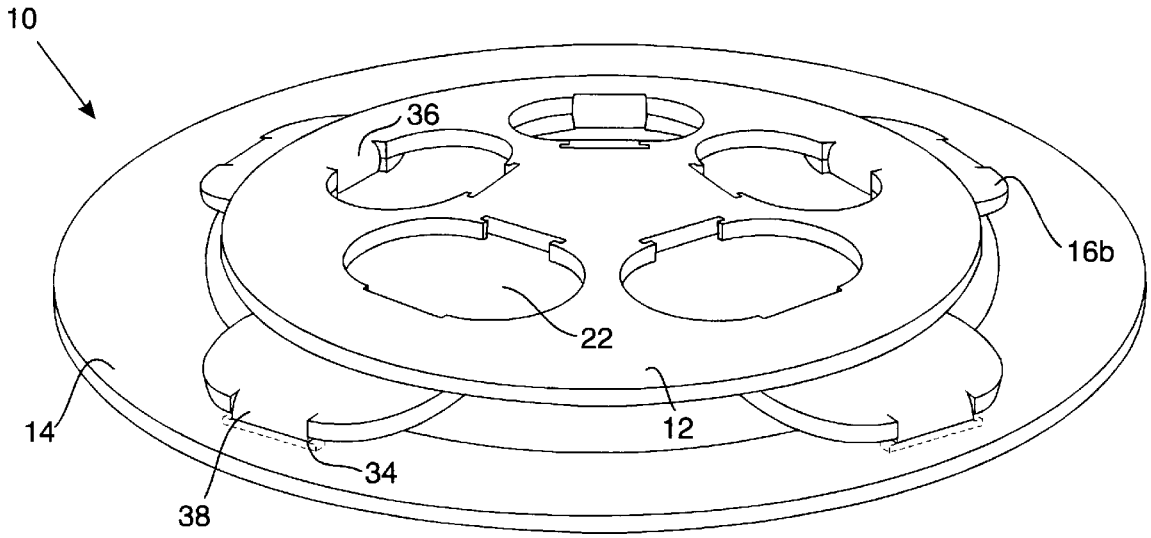
FIG. 2 is a perspective view of the second embodiment of the flying disk of the present invention.

The above described embodiment can be altered to provide a disk that can be easily cut from sheet material while minimizing waste. This alteration is shown in FIG. 2. As seen in this figure, the flying disk 10 of the second embodiment of the present invention includes an upper main disk 12 secured to a lower ring 14 via an attachment means 16*b*. The lower ring 14 is substantially identical in shape, design, and configuration as illustrated and discussed in FIGS. 1*a* and 1*b*. This ring 14, illustrated in FIG. 2 also includes a plurality of slits 34 (illustrated in outline) which extends therethrough. These slits 34 are adapted to receive and maintain the attachment means 16*b*.

Five openings 22 extend through the upper main disk 12. The attachment means is a plurality of tabs. These tabs are formed or cut from the upper main disk, but not completely separated from the upper main disk. This configuration will provide for the attachment means to be hingedly secured to the upper disk by way of the uncut or hinged portion 36. Oppositely located from the hinged portion 36, on each attachment means, is a flap 38. This flap is adapted to be removably secured to the slit 34. These flaps are relatively small in size so not to affect the aerodynamic flight of the flying disk of the present invention.

To successfully employ the flight of the disk, the hinged portion should be closer to the outer edge of the upper main disk than the opening. This will provide for the hinged portion to be located adjacent to the edge while the opening will be located at a further distance from the edge than the hinged portion.

Utilization of the above-described embodiment is similar to the disk discussed in the first embodiment, illustrated in FIGS. 1*a* and 1*b*.

The embodiment discussed above can be altered, so as to eliminate the slits and render the flaps to be secured to the upper surface of the ring via a securing means. This securing means can be any conventional securing means, such as epoxy, glue, paste, rubber cement, adhesives, pins, staples or the like.

Figure 3:
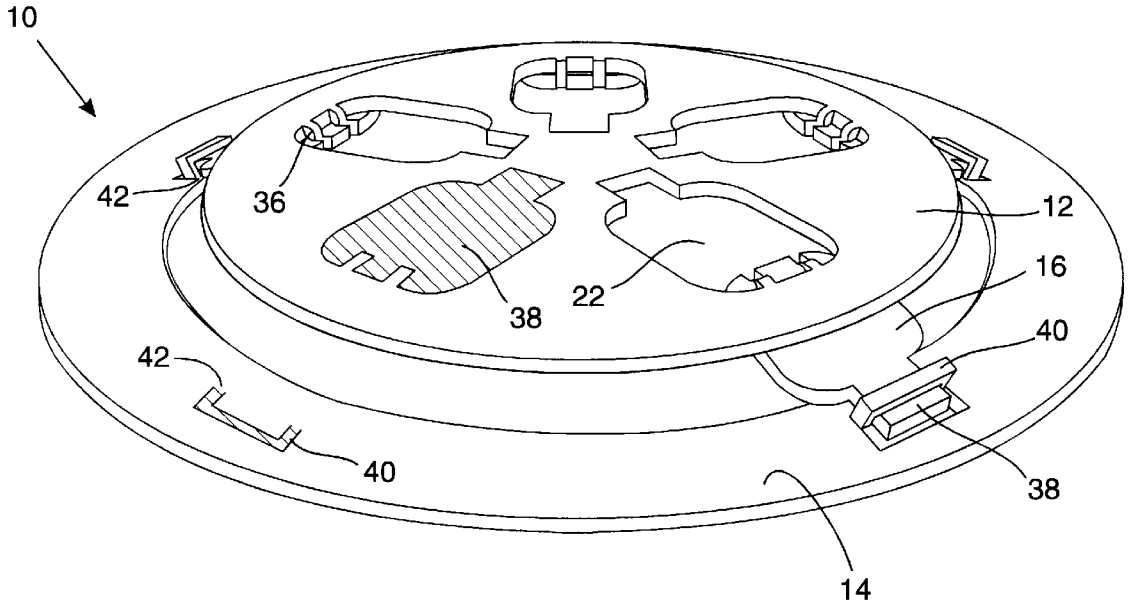
FIG. 3 is a perspective view of the third embodiment of the flying disk of the present invention.

For a more aesthetically pleasing flying disk 10, the hinged or uncut portion 36 of the upper disk member can be cut to form any design and configuration, as illustrated in further detail in FIG. 3. This will provide, not only an attractive hinged means 36, but also for an interesting cut pattern for the apertures 22. The flap 38 can be secured to the lower ring 14 via a connecting means 40. This connecting means, illustrated in FIG. 3, provides for another embodiment of the present invention. As seen in this figure, the connecting means 40 is cut from the ring. This connecting means is U-shaped and is lifted upward to act as a receiving means for the flaps 38. These connecting means 40 includes hinged portions 42 for providing the connecting means to be secured to the lower ring and to be a unibody structure. The hinged portions 42 are the uncut edge of the connecting means 40. This will provide for a structure which is designed to conserve material.

Utilization of the above-described embodiment is similar to the disk discussed in the first embodiment, illustrated in FIGS. 1*a* and 1*b*.

The attachment means can also be designed to extend outwardly from the lower ring 14. This alteration is illustrated in further detail in FIG. 4. As seen in this figure, the fourth embodiment of the present invention, the flying disk 10 includes an upper main disk 12 that is connected to a lower ring 14 via an attachment means 16*c*.

Extending through the upper main disk 12 are five apertures 22. These apertures 22 are evenly spaced and are located in proximity to the edge of the upper main disk 12. Also located on the upper main disk, in the proximity of the outer edge 32 are a plurality of receiving means 44. These receiving means are adapted to receive and maintain the attachment means 16*c*. The receiving means 44 in this figure is illustrated as a T-shaped cut-out located within the upper main disk.

The attachment means 16*c* is formed from a plurality of tabs. These tabs extend outwardly from the central aperture 26 of the lower ring. These tabs each include a flap 38 which is adapted to be removably secured within the receiving means 44.

Once the tabs are secured within the receiving means, the flying disk is ready to be flown. Flying occurs in the same manner and functions similarly as discussed in the first embodiment.

Figure 4:
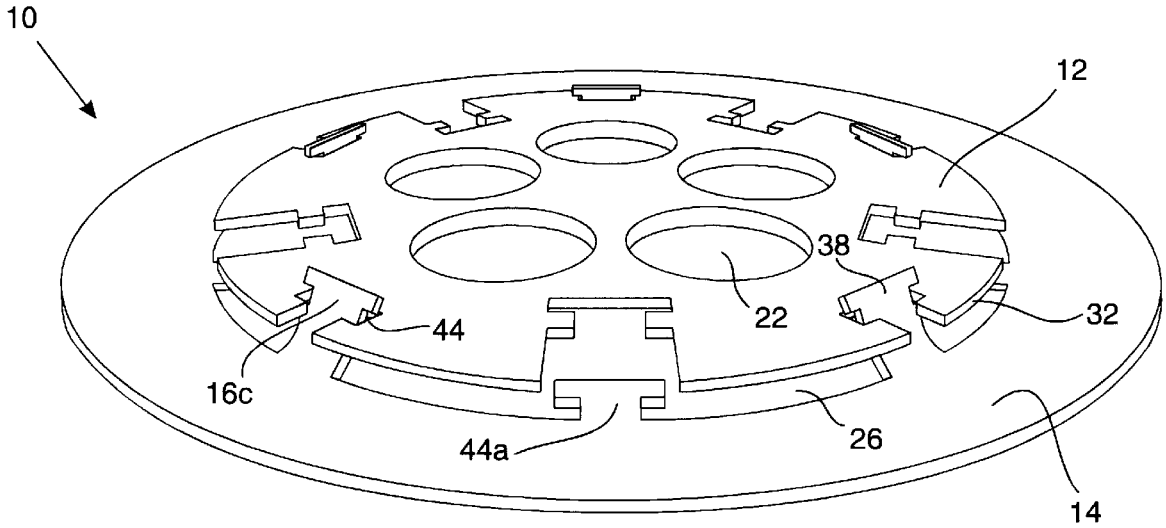
FIG. 4 is a perspective view of the fourth embodiment of the flying disk of the present invention.

The embodiment illustrated in FIG. 4 also shows additional openings configured the same as the tabs 38, but larger. These openings (illustrated, but not labeled) provide an interesting pattern for the upper main ring while still providing for the surface are of the uncut portion to be substantially the same (plus or minus 10 percent) of the surface area of the cut portion. This will still enable the air to form a vortex when the device 10 is in flight. Tabs 44*a* are used for aesthetic reasons and are significantly small so not to affect the aerodynamic flight of the device 10.

It is noted that in all the embodiments that the attachment means must be disposed horizontally. This will prohibit obstruction of the air flow. Hence, horizontal displacement will enhance the flight of the flying disk.

The material used for the upper main disk, lower ring and attachment means can be comprised of any light weight material, such as card board, poster board, ionomer foam, or the like. This light weight material is ideal for indoor use. Stronger, heavier, hard, and more durable material can be used for outdoor use, such as, but not limited to plastic, vinyl, resins, such as LEXAN™, for hard rubber, or the like. The various elements which form the flying disk of the present invention, upper main disk, lower ring and attachment means, can be constructed from the same material, or optionally can be constructed from different material. For example, the upper main disk and lower ring can be fabricated from ionomer foam while the attachment means can be fabricated from card board.

Figure 5:
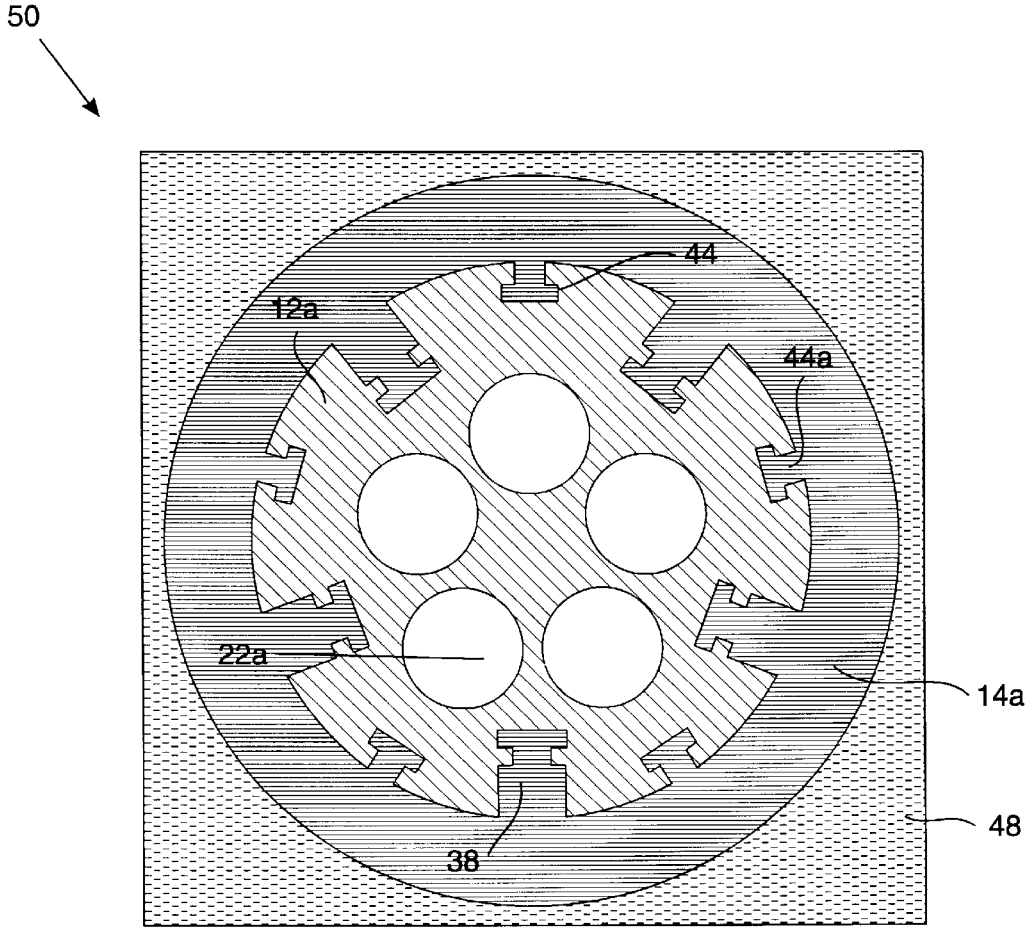
FIG. 5 is a front planar view of flying disk of the present invention prior to assembly.

The above described embodiments can be constructed in their entirety from a single unit and can be designed so as to conserve material. As seen in FIG. 5, a sheet of material is printed and cut with a desired pattern from a die. The apertures 22 are formed from removing the excess material 22*a*. The attachment means 16 is also formed from separating the upper main disk 12*a* from a lower ring 14*a*. Once removed receiving means 44 are inherently formed. The excess material from the receiving means 44*a* (see FIGS. 4 and 5) form an interesting and attractive element to the flying disk of the present invention without departing from the aerodynamic flight of the flying disk.

Separation of the various elements of the flying disk can be accomplished by the consumer for enabling the consumer to construct the flying disk. Optionally, the manufacture may remove the elements discard all non-usable material (excess material 22*a*) and package the product for construction by consumer. Further still, the manufacturer can assemble the flying disk of the present invention for the consumer.

While the invention has been particularly described and shown with reference to an embodiment thereof, persons skilled in the art will understand that various changes in form and detail may be made without departing from the spirit and scope of the invention.

I claim:

1. A flyer comprising:

a generally circular and generally planar disk having a plurality of spaced apart apertures each aperture having a first diameter, wherein said apertures enable air to form a vortex when the flyer is thrown;

a generally circular and generally planar ring having an opening; and a plurality of tabs, each having a top connected to the disk, a bottom connected to the ring an arcuate outer periphery and a second diameter that is generally equal to the first diameter.

2. The flyer as in claim 1 wherein the disk has a first diameter and the opening has a second diameter that is approximately equal to the first diameter.

3. The flyer as in claim 1 wherein the disk has a first area and the plurality of apertures have a combined second area that is in the range of about forty percent to about sixty percent of the first area.

4. The flyer as in claim 1 wherein the plurality of apertures total five in number.

5. The flyer as in claim 1 wherein each of the plurality of tabs is generally planar.

6. The flyer as in claim 1 wherein the disk has an outer edge that is positioned generally normal to the plane defined by the disk.

7. The flyer as in claim 1 wherein the ring has an outer edge that is positioned generally normal to the plane defined by the ring.

8. A flyer comprising:

a generally circular and generally planar disk having a plurality of spaced apart apertures each aperture having a first height, wherein said apertures enable air to form a vortex when the flyer is thrown;

a generally circular and generally planar ring having an opening; and a plurality of tabs, each having a top connected to the disk, a bottom connected to the ring, an arcuate outer periphery and a second height that is generally equal to the first height.

9. The flyer as in claim 8 wherein the disk has a first diameter and the opening has a second diameter that is approximately equal to the first diameter.

10. The flyer as in claim 8 wherein the disk has a first area and the plurality of apertures have a combined second area that is in the range of about forty percent to about sixty percent of the first area.

11. The flyer as in claim 8 wherein the plurality of apertures total five in number.

12. The flyer as in claim 8 wherein the disk has an outer edge that is positioned generally normal to the plane defined by the first disk.

13. The flyer as in claim 8 wherein the ring has an outer edge that is positioned generally normal to the plane defined by the ring.

* * * * *